US007667126B2

(12) United States Patent
Shi

(10) Patent No.: US 7,667,126 B2
(45) Date of Patent: Feb. 23, 2010

(54) METHOD OF ESTABLISHING A HARMONY CONTROL SIGNAL CONTROLLED IN REAL-TIME BY A GUITAR INPUT SIGNAL

(75) Inventor: Guangji Shi, Victoria (CA)

(73) Assignee: The TC Group A/S (DK)

( * ) Notice: Subject to any disclaimer, the term of this patent is extended or adjusted under 35 U.S.C. 154(b) by 0 days.

(21) Appl. No.: 12/047,049

(22) Filed: Mar. 12, 2008

(65) Prior Publication Data

US 2008/0223202 A1 Sep. 18, 2008

Related U.S. Application Data

(60) Provisional application No. 60/894,301, filed on Mar. 12, 2007.

(51) Int. Cl.
*G10H 1/38* (2006.01)
*G10H 7/00* (2006.01)

(52) U.S. Cl. ..... 84/616; 84/613

(58) Field of Classification Search ..... 84/613, 84/637, 616

See application file for complete search history.

(56) References Cited

U.S. PATENT DOCUMENTS 5,446,238 A * 8/1995 Koyama et al. ..... 84/669
6,124,544 A * 9/2000 Alexander et al. ..... 84/616
6,372,973 B1 * 4/2002 Schneider ..... 84/609
6,657,114 B2 * 12/2003 Iwamoto ..... 84/610

* cited by examiner

*Primary Examiner*—Jeffrey Donels
(74) *Attorney, Agent, or Firm*—Cantor Colburn LLP

(57) ABSTRACT

The invention relates to a method of establishing a harmony control signal controlled in real-time by a guitar audio input signal (GAS), comprising the steps of providing a first input harmony input control signal (FIH) on the basis of said guitar audio input signal (GAS), providing a second input harmony control signal (SIH) on the basis of a voice audio input signal (VAS).

Figure 1A:
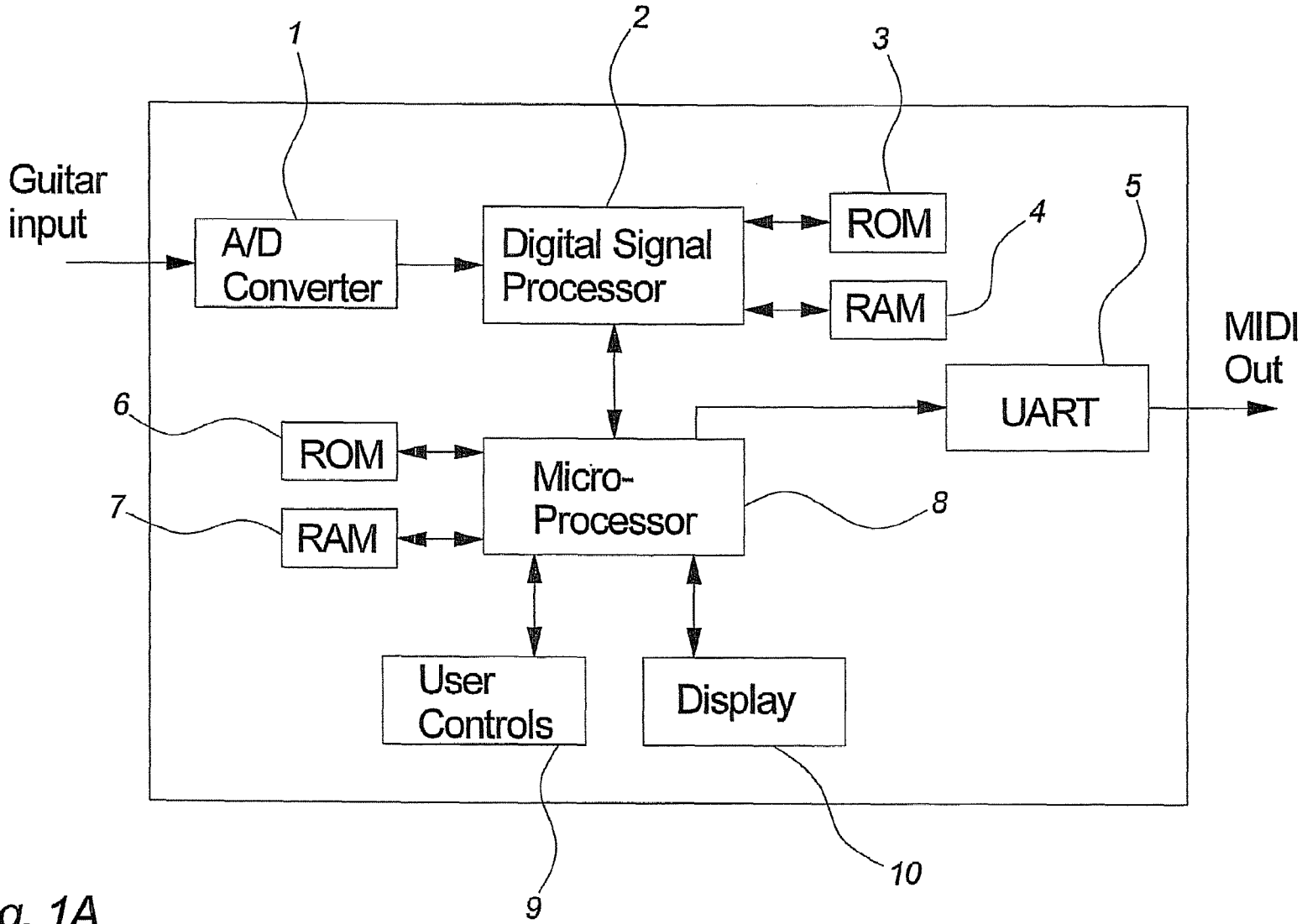

providing an input audio extraction representation (IAER) on the basis of said first input harmony input control signal (FIH), establishing a harmony control signal (HCS) on the basis of said input audio extraction representation (IAER) and said second input harmony control signal (SIH).

26 Claims, 9 Drawing Sheets

METHOD OF ESTABLISHING A HARMONY CONTROL SIGNAL CONTROLLED IN REAL-TIME BY A GUITAR INPUT SIGNAL

CROSS REFERENCE TO RELATED APPLICATION

This application claims the benefit of U.S. Provisional Application No. 60/894,301 filed Mar. 12, 2007, the contents of which are incorporated by reference herein in their entirety.

FIELD OF THE INVENTION

The invention relates to a method of establishing a harmony control signal controlled in real-time by a guitar audio input signal and an apparatus for implementing the method.

BACKGROUND OF THE INVENTION

A problem in the prior art has been that state-of-the-art harmony processors are somewhat restricted in use due to the fact that such real-time processors are controlled by keyboards or other monophonic control signal establishing provisions. A keyboard is well-suited for the purpose as keyboards by nature establishes such control signals typically as a so-called MIDI (Musical Instrument Digital Interface) signal, which may be transmitted by simple measures to other relevant devices such as other keyboards, modules, audio processors, sequencers, etc. The control signals provided are typically polyphonic and regarded as well-suited for the purpose of controlling e.g. a harmony processor in real-time.

A challenge in this connection has been that instruments, in particular polyphonic instruments such as guitars, establishes the desired tones mechanically and that such tones are therefore represented as an audio signal without the use of tone generators, etc. as in systems where keyboards are applied. Basically, such an "analog" musical instrument provides a resulting audio signal comprising no control information regarding choice of tones, volume, sustain, pitch, etc. Such information may, however, be derived e.g. in batch processing as the information must be derived by means of significant processing power.

Moreover, a further problem is that a real-time harmony processing by nature requires a voice input as an input signal simultaneous with the above-mentioned analysis in order to provide the voice material upon which a the harmony processing may be based.

SUMMARY OF THE INVENTION

The invention relates to method of establishing a harmony control signal controlled in real-time by a guitar audio input signal (GAS), comprising the steps of

- providing a first input harmony input control signal (FIH) on the basis of said guitar audio input signal (GAS),
- providing a second input harmony control signal (SIH) on the basis of a voice audio input signal (VAS).
- providing an input audio extraction representation (IAER) on the basis of said first input harmony input control signal (FIH),
- establishing a harmony control signal (HCS) on the basis of said input audio extraction representation (IAER) and said second input harmony control signal (SIH).

The harmony control signal (HCS) may within the scope of the invention comprise the complete signal required for establishment of a harmony. Thus, when e.g. implementing the invention in as two separate units coupled through MIDI, the harmony control signal may advantageously be established by a harmony processor. A pre-stage to this harmony control signal may be established in a separate unit coupled to the harmony processor by means of MIDI, and the pre-stage signal,—the input audio extraction representation (IAER), may then be established as a chord/harmony/scale-extraction information which may be transferred to the harmony processor as chord-forming notes readable on the MIDI input of the harmony processor together with further control signals adding, e.g. transmitted as MIDI exclusive, which may be applied by the harmony processor as a basis for establishing the finally rendering polyphonic harmony.

The input audio extraction representation (IAER) may e.g. comprise so-called pitch class information. Definitions and explanation on pitch class information is explained in detailed description. It may further comprise information related to analysis of the input signals, i.e. at least the polyphonic guitar signal and optionally and preferably also on information obtained from the second input harmony control signal (SIH). Such information may e.g. comprise chord detection, scale detection, automatic key detection, etc. According to an advantageous embodiment of the invention, such information comprises a combination of chord and scale information. Chord information may be based on analysis of the first input harmony input control signal (FIH), e.g. an input from a guitar alone or it may be based on analysis of the first input harmony input control signal (FIH) in combination with the second input harmony control signal (SIH). In other words, note information may be combined from the two mentioned inputs. Scale information may e.g. be based on the first input harmony input control signal (FIH) or the second input harmony control signal (SIH) alone or in combination. As the second input harmony control signal is typically monophonic, this signal will be very suitable for scale extraction.

A harmony control signal (HCS) basically relates to signals which may add one or further harmonies to the second input harmony control signal (SIH). In other words, a harmony control signal is established on the basis of information extracted from the first input harmony input control signal (FIH) and preferably also the second input harmony control signal (SIH).

According to a preferred embodiment of the information a correlation between chord and scale may be established for the purpose of e.g. correcting established harmonies on the basis chord detections.

According to an embodiment of the invention, the input audio extraction representation (IAER) where the input audio extraction representation is based on both the first and the second input harmony control signal (SIH). In this way, the information lacking from one input may obtained through combination with the other input. A primitive example may e.g. comprise a note detection from the first input, e.g. a guitar and a one-note detection from the second input and where the detected three notes together may be extracted to be a chord.

In an embodiment of the invention a polyphonic voice signal (PVS) is provided on the basis of a voice harmony control signal (HCS).

The polyphonic voice signal is typically an audio signal represented analog or digitally. The polyphonic voice signal (PVS) may e.g. be established in a separate unit by a state of the art harmony processor under control of the voice harmony control signal (HCS) insofar the harmony processor are able to receive and interpret the control signals.

A polyphonic voice signal may also be referred to as a harmony voice signal comprising two or more different voice tones. Such a harmony may e.g. comprise one voice signal basically corresponding to the second input harmony control signal and at least one further harmony tone based on a pitch modulation of the second input harmony control signal, i.e. the voice audio input signal (VAS).

In the present context, a real-time method is regarded as a method which may be applied for live performance. In other words, relatively small delays may appear trough the system, as long as the delay will not result in a delay of the harmony to be produced in a degree that obscures the live performance.

The first input harmony input control signal (FIH) may e.g. be a direct A/D converted version of the guitar audio input signal (GAS) or any derivative or modification thereof.

The second input harmony control signal (SIH) may e.g. be a direct A/D converted version of the voice audio input signal (VAS) or any derivative or modification thereof.

The first input control signal representing a guitar audio input signal may typically be formed on the basis of an A/D conversion of an analog input from a guitar. The signal is by nature polyphonic, although, a guitar player may evidently choose to play monophonic from time to time.

According to the present invention a guitar input is typically polyphonic and by nature polyphonic when playing chords.

The polyphonic voice signal (PVS) may e.g. be provided by a prior art harmony processor such as the TC Helicon Voice Live by communicating relevant input audio extraction representation (IAER) to the unit by means of MIDI.

In an embodiment of the invention said sample rate is less than about 13 kHz.

According to a most preferred embodiment of the invention, it has been realized that information, audio extraction representations, may be extracted from the input audio guitar signal at very low sample rates, less than about 13 kHz, thereby enabling the complete process of evaluating a polyphonic guitar input signal, extracting the relevant information and establishing a polyphonic voice signal (PVS) on the basis of said input audio extraction representation (IAER) on the basis thereof.

A surprising effect of the invention is thus that a real-time establishment of voice harmonies may be established if the sample rate of the controlling polyphonic guitar input signal is sufficiently low. This is definitely a breakthrough in relation to establishment of polyphonic voice harmonies as reliable extraction based on a polyphonic guitar in a live-environment would be expected to rely on not only the fundamental tones but more likely on the harmonics thereof. A detection on harmonics would e.g. result in a faster output from e.g. an FFT algorithm as the wavelengths are very low.

In an embodiment of the invention said low rate is less than about 13 kHz and greater than about 1.3 kHz.

According to an embodiment of the invention, a sample rate lower than about 13 kHz is sufficient to establish input audio extraction which may be applied for the purpose of real-time establishment of voice harmonies on the basis of a guitar audio input signal. When keeping a low intermediate sample rate, the extraction performed on the input signal may be performed at sufficient high speed in order to obtain the relevant extracted guitar audio information and at the same time provide a voice harmony fast enough to facilitate a live—real-time—establishment of harmonies.

In an embodiment of the invention an audio extraction representation is obtained through detection of fundamental tones of a guitar input of less than 6.5 kHz, preferably less than through detection of fundamental tones of a guitar input of less than 4.5 kHz.

In an embodiment of the invention said audio extraction representation is obtained through detection of fundamental tones of a guitar input of less than 3.0 kHz.

In an embodiment of the invention a first input harmony input control signal (FIH) is provided on the basis of A/D conversion of said guitar audio input signal (GAS).

In an embodiment of the invention a first input harmony input control signal (FIH) is provided on the basis of A/D conversion of said guitar audio input signal (GAS) and a subsequent down-sampling of said audio input signal (GAS).

According to an embodiment of the invention, the guitar input signal is A/D converted at a relatively high sample rate—such as 44.1 kHz and subsequently down-sampled to a sample rate less than about 13 kHz and greater than about 1.3 kHz. By this technique, the guitar input signal may be subject to e.g. room processing or other relevant audio processing as a normal audio processing requires a higher sample rate than the sample rate required for the audio extraction representation.

In an embodiment of the invention an input audio extraction representation (IAER) is established on the basis of said first input harmony input control signal (FIH) and said second input harmony control signal (SIH).

According to an embodiment of the invention, information extraction applicable for the subsequent harmony generation may furthermore be obtained on the basis of analysis of both the first input harmony input control signal (FIH) and the second input harmony control signal (SIH), i.e. typically the a guitar input and a voice input. The audio extraction may thus both rely on information provided and extracted from the guitar input and information provided and extracted from the voice input.

The first input harmony input control signal (FIH) and the second input harmony control signal (SIH) may be analyzed in one combined process or two separate processes. The two processes may according to one embodiment of the invention be established as two processes performed in separate hardware. The hardware may e.g. communicate via MIDI.

In an embodiment of the invention said input audio extraction representation (IAER) is established on the basis of said first input harmony input control signal (FIH), said second input harmony control signal (SIH) and at least one further input signal (FIS).

The at least one further input signal (FIS) may e.g. comprise an input from a further instrument, monophonic or polyphonic and the further input signal may both comprise an audio signal or e.g. a control signal in the form of e.g. a MIDI signal.

Evidently, more than one further input signal may be applied for extraction purposes.

Relevant information from the one or a plurality of further input signals may be both polyphonic or monophonic as even monophonic information may be applied for the purpose of deriving very important scale information which, in addition to chord information may result in a strong and efficient control and establishment of the voice harmony control signal HCS and thereby the polyphonic voice signal (PVS).

In an embodiment of the invention said first input harmony input control signal (FIH) us analyzed in time windows of less than about 1500 ms, preferably less than about 1000 ms.

The maximum value strongly relates to the maximum acceptable delay through the system as an extraction which delays the output generation of a polyphonic voice signal too much would comprise the abilities of using the method in live applications.

In an embodiment of the invention said first input harmony input control signal (FIH) is analyzed in time windows of more than about 80 ms, preferably more than about 100 ms.

The minimum time window relates to the input guitar signal and should be long enough to facilitate detection of the lowest relevant frequency component at the input. Presently, such lowest frequency may e.g. have a frequency of about 70-85 Hz.

In an embodiment of the invention said first input harmony input control signal (FIH) is analyzed in time windows of 80 ms to 1500 ms.

In an embodiment of the invention said first input harmony input control signal (FIH) is analyzed in time windows of 100 ms to 1000 ms.

In an embodiment of the invention said first harmony input control signal is analyzed in overlapping time windows, preferably by FFT evaluation.

Any suitable algorithm for detection of notes may be applied within the scope of the invention when extracting information from each time window. Presently, an FFT evaluation or any other suitable derivative thereof may be applied within the scope of the invention.

In an embodiment of the invention the overlapping time windows are repeated and analyzed in intervals less that the duration of the time window.

By repeating the analyzing in overlapping time windows it is possible to update and react on critical information in an efficient manner, as the detection delay may now be reduced to less than the duration of two time windows and some times to much less, depending on the polyphonic guitar signal.

In an embodiment of the invention the overlapping time windows are repeated and analyzed in intervals less than 100 ms, preferably less than 50 ms.

The overlapping time window may e.g. be repeated in shorter intervals, such as down to about 2-4 ms. E.g. about 5- to about 40 ms.

In an embodiment of the invention the input audio extraction representation is established by note detection.

According to an embodiment of the invention, input audio extraction representation comprises notes extracted from the guitar audio input. Further information may be extracted.

In an embodiment of the invention the input audio extraction representation is established by note and chord detection.

In an embodiment of the invention the input audio extraction representation is established by note and chord and scale detection.

In an embodiment of the invention the establishing a voice harmony control signal (HCS) and/or the polyphonic voice signal (PVS) is provided on the basis of said input audio extraction representation (IAER) and said second input harmony control signal (SIH) and wherein said polyphonic voice signal (PVS) is established as an output signal time-synchronized with said second input harmony control signal (SIH).

In an embodiment of the invention the establishing a voice harmony control signal (HCS) and/or the polyphonic voice signal (PVS) is provided on the basis of said input audio extraction representation (IAER) and said second input harmony control signal (SIH) and wherein said polyphonic voice signal (PVS) is established as an output signal time-synchronized with said first input harmony input control signal (FIH).

In an embodiment of the invention the polyphonic harmony is established as a harmony of two or more different voices and wherein one of the voices is based on the second input harmony control signal (SIH) and wherein the at least another of the voices are based on a pitch shifted version of said second input harmony control signal (SIH) and wherein said two or more voices are time-synchronized with said second input harmony control signal (SIH).

In an embodiment of the invention the input audio extraction representation (IAER) deduces chords on the basis said first input harmony control signal (FIH) and scale information on the basis of said second input harmony control signal (SIH).

In an embodiment of the invention a hardware structure comprising a signal processor for implementing the above-described method is provided.

The required hardware structure may comprise any suitable prior art signal processor, any suitable associated memory, cache, bus, store and audio converters.

In an embodiment of the invention the hardware is divided into two separate units, the first unit comprising an input ( ) for said first input harmony control signal (FIH) the second unit comprising an input ( ) for said second input harmony control signal (SIH)

wherein the two units communicates via a digital interface, e.g. a MIDI interface.

In an embodiment of the invention the hardware is implemented on a computer such as a PC or a Macintosh.

In an embodiment of the invention the hardware is implemented in a stand alone unit.

The stand alone unit may preferable comprise a foot-controlled pedal.

In an embodiment of the invention the first input harmony input control signal (FIH) is established by a high resolution A/D converter.

The prior art does not consider using relevant information from several simultaneous audio sources and/or user inputs. Very often, relevant additional or supporting information is available from using several sources which together form a much more robust basis for accurate determination of key scale and harmony determination relevant information. Such additional sources may e.g. be several voice inputs, string instrument inputs, keyboard and piano audio, brass instrument inputs as well as audio and midi information from electronic instruments sources and accompanying electronically based playback devices.

In addition to having direct source inputs, additional relevant sources may be applied.

The emerging appearance of audio networks allows a further relevant facility to provide the above relevant additional information for accurate as well as enhanced harmony determination.

Different from chord detection, the basis for harmony generation is primarily a desire to quickly and accurately detect the relevant actual key and scale in which a piece of music is played, secondarily on the basis of sung notes to produce harmony generating outputs in accordance with default or desired harmony types.

The harmony generation may take such form as to produce less advanced harmonies in the case that the available extracted information is of a less substantial or robust character, and visa versa produce more advanced harmonies as the available information is of a more substantial or robust character.

Historical ("Pitch octave profile") pitch harmony relevant information may be kept to enhance or substantiate and increase the harmony decision logic process to increase robustness and accuracy. Schemes for increasing robustness include statistical and repeated value type logic as well as neural networks type processing to allow such improvements.

Different features of different specific embodiments of the invention may moreover e.g. be:

An apparatus for extracting important harmony information in real-time from a guitar audio input. The device may advantageously comprise a filtering and down-sampling module which down-samples the signal to lower sampling rate; a time domain partitioning module which partitions the time domain signal into a sequence of overlapping short segments (frames); a frame attributes check module which checks the properties of each frame; a windowing and FFT (Fast Fourier Transform) processing module which transforms each valid frame into frequency domain; a pitch class profile estimation module which estimates pitch class profile from the frequency spectrum; a harmony extraction module which extracts important MIDI notes for harmony.

The filtering and down-sampling module may down-sample the input audio signal to be no more than 12 kHz and no less than 1.3 kHz for efficient and reliable common harmony information extraction processing. This module can optionally apply a low-cut filter with cut-off frequency no more than 85 Hz to reduce low frequency noise.

The time domain partitioning module may divide the down-sampled signal into a sequence of overlapping frames with step size no more than 100 milliseconds. The duration of each frame should be no more than 1 second and no less than 100 milliseconds.

A frame attribute check module may check the attributes of each frame to determine whether the frame is suitable for harmony information processing using one or multiple checking methods such as voiced/unvoiced check and frame energy check.

A windowing and FFT processing module which may window each frame and may transform the windowed frame into frequency domain using FFT. The windowing function may include Hanning, Hamming, etc.

A pitch class profile estimation module may compute the pitch class profile based on the frequency spectrum. It calculates the strength of a semitone using the peaks found within the frequency span of the semitone. It then calculates the pitch class strength profile by summing the strength of semitones that belong to the same pitch class.

A chord estimation module may extract important harmony notes based on the pitch class profile, the music key and scale, and optionally with lead vocal input and historical data.

A harmony information extraction system may optionally detect the best matching key and scale dynamically based on/or supplemented by a MIDI note history received from a MIDI generating device.

A harmony information extraction device can output standard MIDI output to drive an existing harmony product with MIDI interface.

A harmony information extraction device may feature an enable/disable interface to allow a user to engage or disengage the harmony information processing, e.g. by foot control.

A harmony information extraction device can optionally provide a guitar tuner which tunes a guitar with a reference frequency of 440 Hz.

A harmony information extraction device can optionally provide the interface to allow a user to specify a key and scale either through manual selection or by playing on a guitar.

A harmony information extraction device can optionally provide the interface to allow a user to specify the playing style.

A harmony information extraction device can be optionally changed to a non real-time mode to handle the corresponding functionalities.

One of several objects of the present invention is to overcome the drawbacks in the prior art methods and apparatuses, and to provide a real-time harmony information extraction device which is capable of extracting important harmony information quickly and accurately.

According to an embodiment of the present invention, the system first filters and down-samples the guitar input signal. It then partitions the down-sampled signal into overlapping short-time segments (frames). For each frame, it checks its attributes to determine whether this frame is suitable for further analysis. Each valid frame is windowed and transformed into the frequency domain through FFT to obtain the frequency spectrum. The system then computes the pitch class profile using the peaks detected within a frequency span of a semitone. It then determines the important harmony notes using the pitch class profile, the music key and scale, and optionally with historical data and vocal input.

According to one aspect of an embodiment of the invention, the system down-samples the input signal to be no more than 12 kHz and no less than 1.3 kHz for efficient and reliable guitar MIDI note extraction. It can optionally cut frequency no more than 85 Hz to remove low frequency noise.

According to another aspect of an embodiment of the invention, the system partitions the filtered and down-sampled signal into overlapping frames with step size no more than 100 milliseconds. The interval of each frame is no more than 1 second and no less than 100 milliseconds. The small step size improves the time resolution of information extraction, and reduces the processing latency.

According to a further aspect of an embodiment of the invention, the system checks the attributes of each frame to determine whether the frame is suitable for harmony information extraction. The goal is to skip frames that are not suitable for harmony information extraction.

According to a still further aspect of an embodiment of the invention, each selected frame is windowed and transformed into frequency domain to compute the pitch class profile. The system determines the strength of each semitone using peaks detected within the frequency span of the semitone, and computes the pitch class profile by adding the note strengths that belong to the same pitch class.

According to a feature of an embodiment of the invention, the system determines the important MIDI notes by considering the pitch class profile, the music key and scale, and optionally considers vocal input and historical data.

Other objects, advantages, and features of this invention will be apparent from the detailed descriptions and drawings.

THE FIGURES

The invention will be described with reference to the figures of which

Figure 1B:
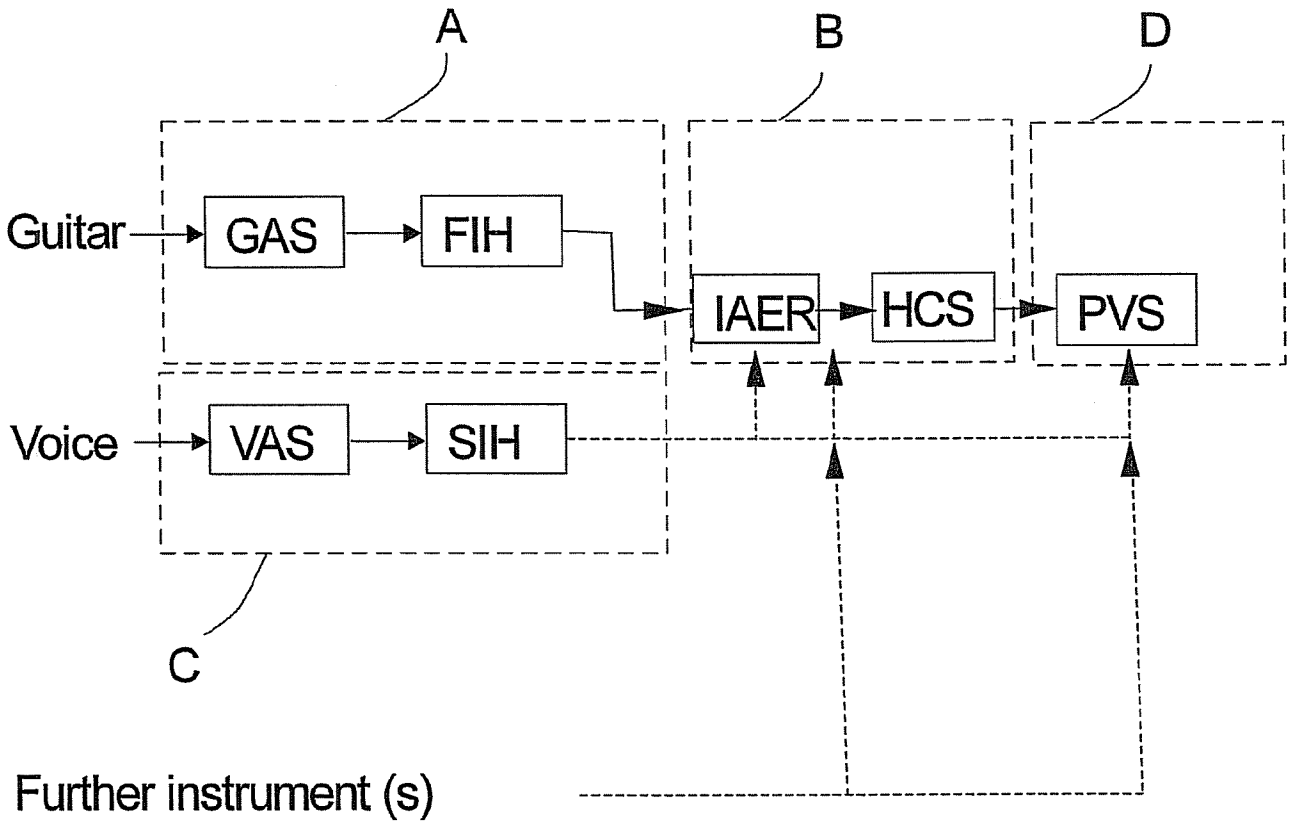
Figure 2A:
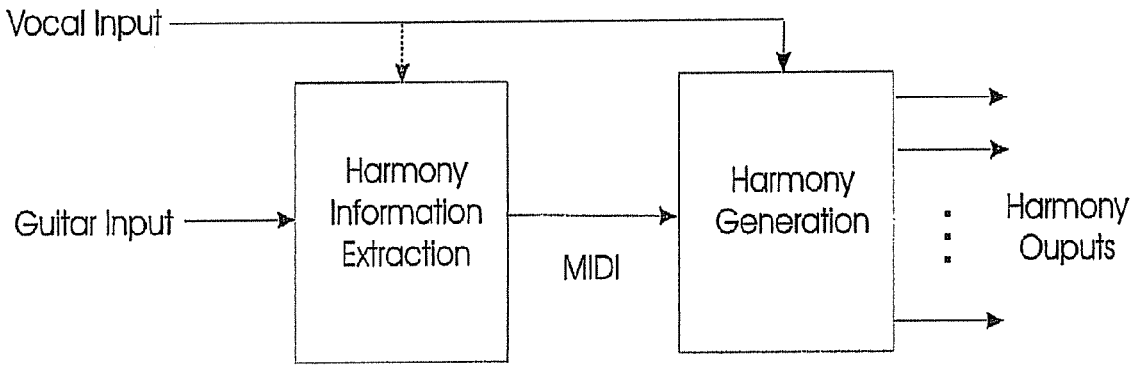
Figure 2B:
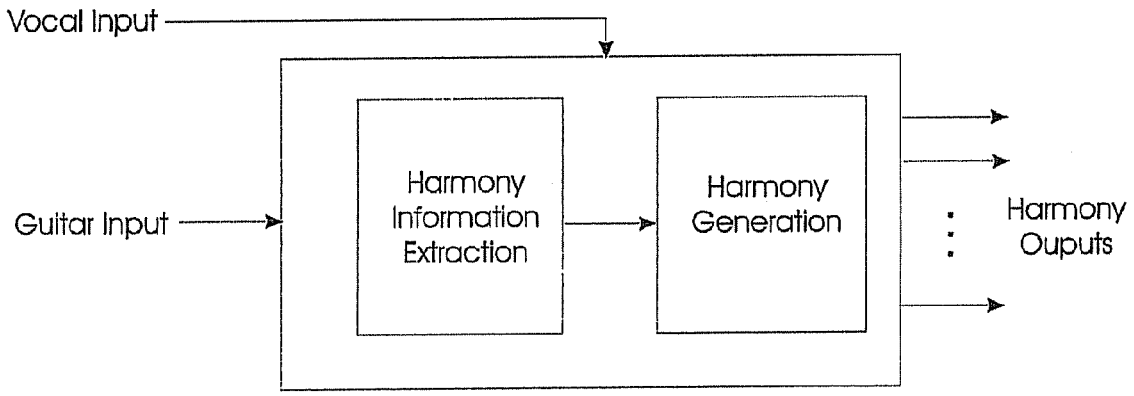
Figure 3:
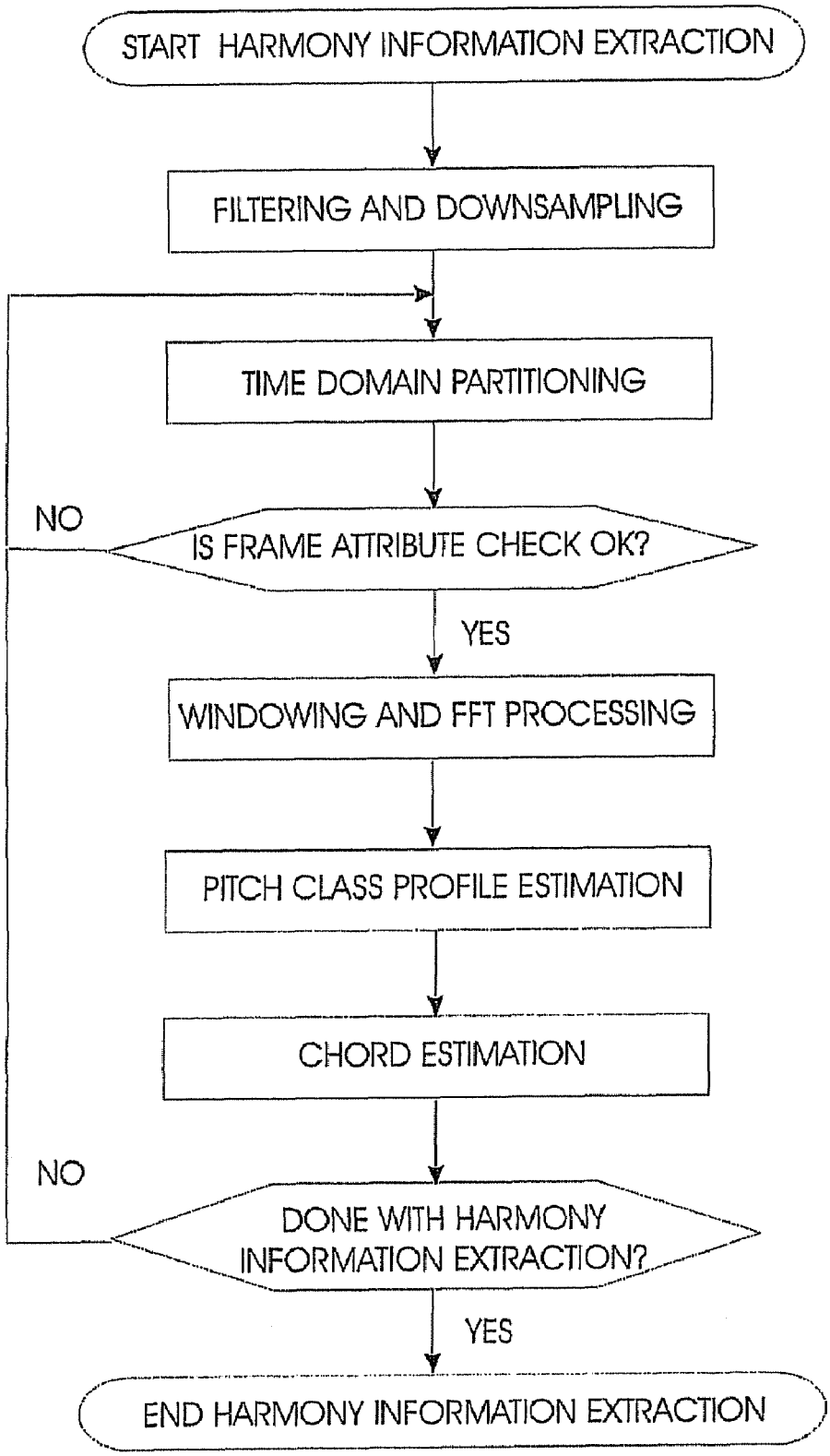
Figure 4:
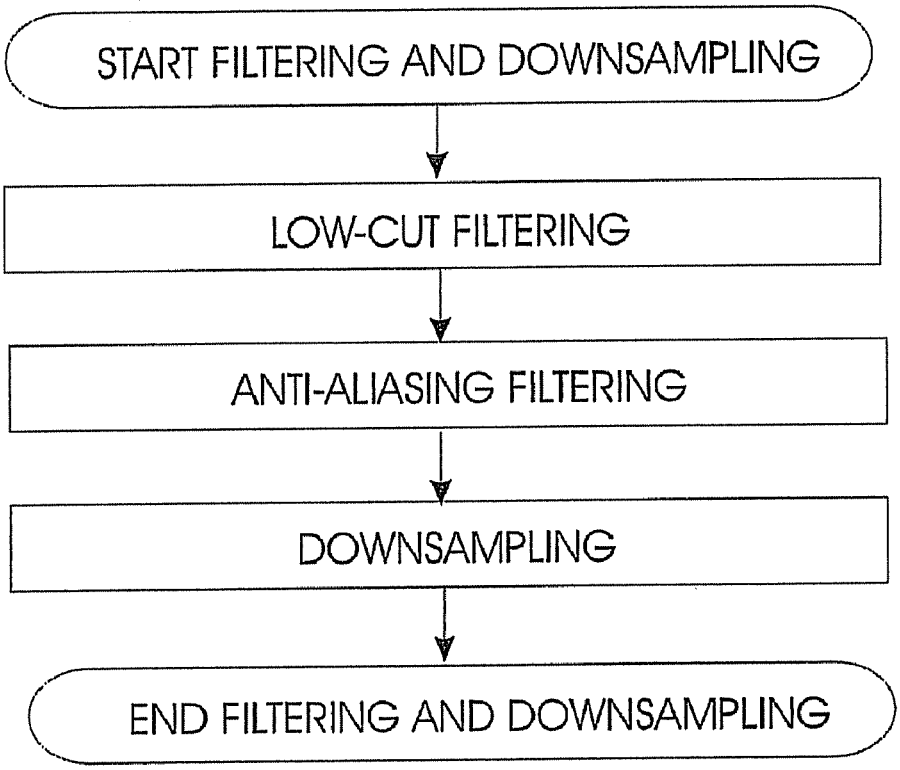
Figure 5:
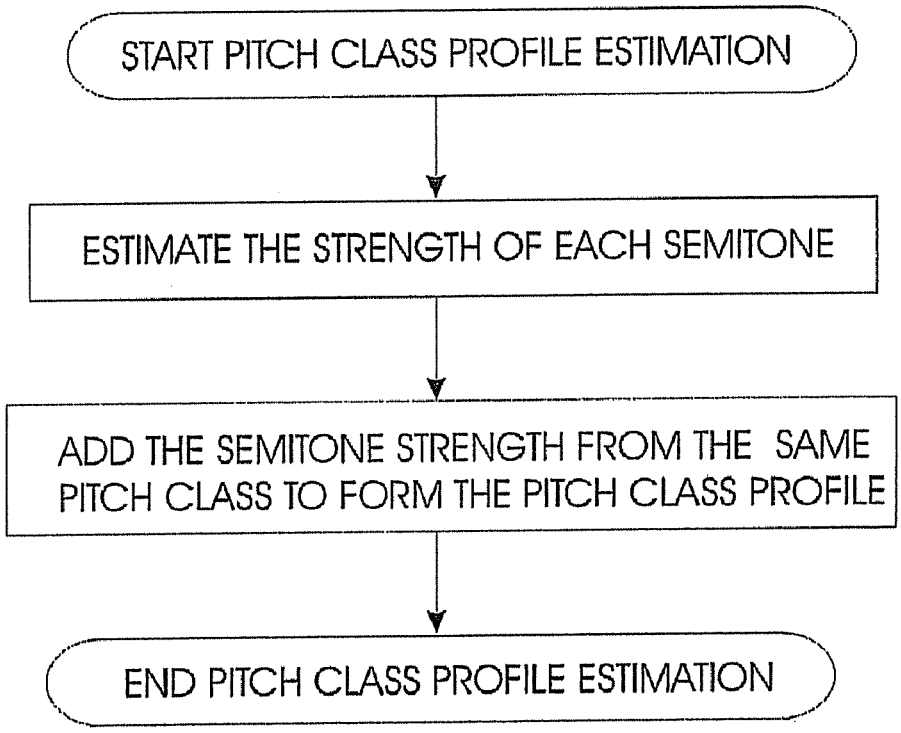
Figure 6:
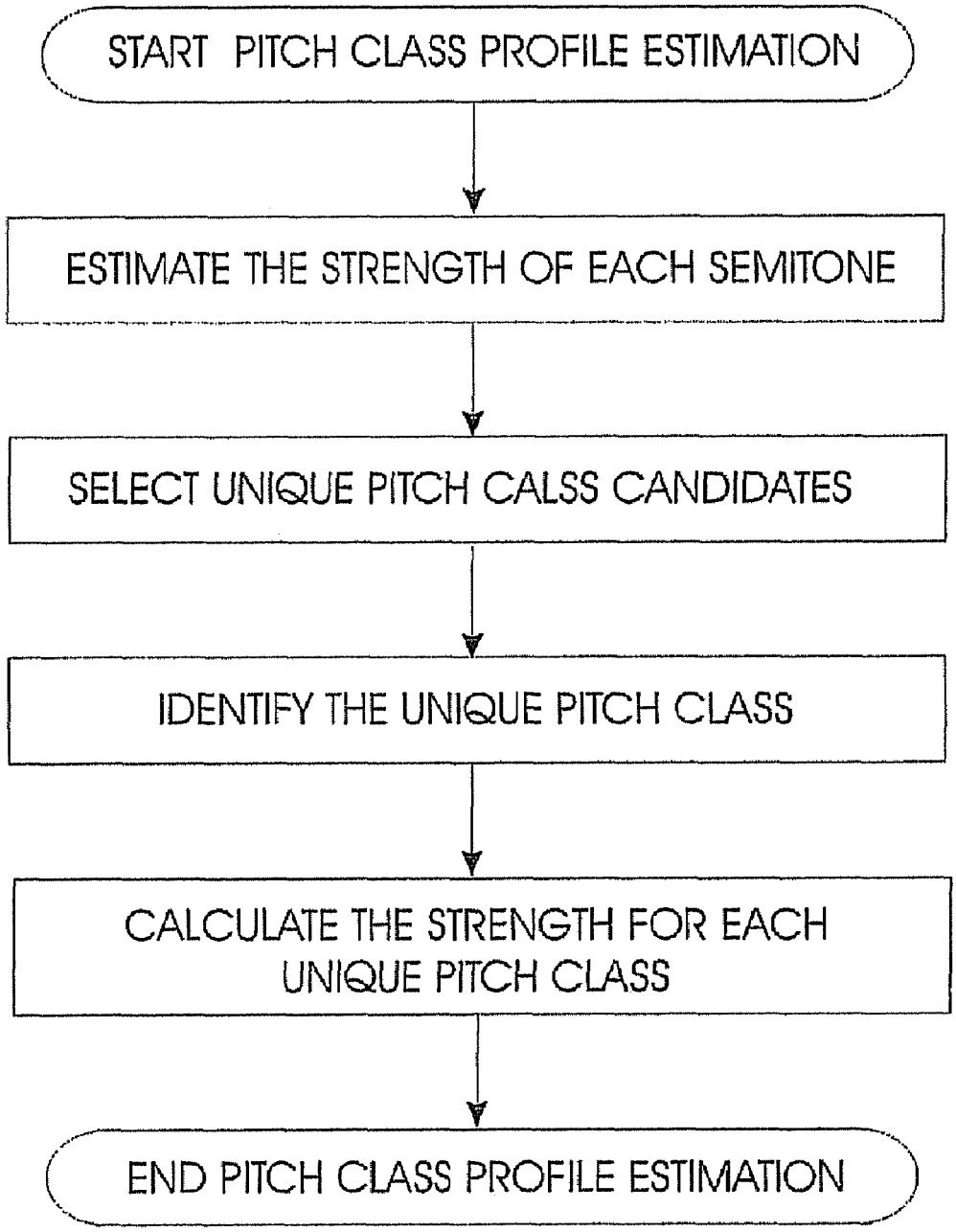
Figure 7:
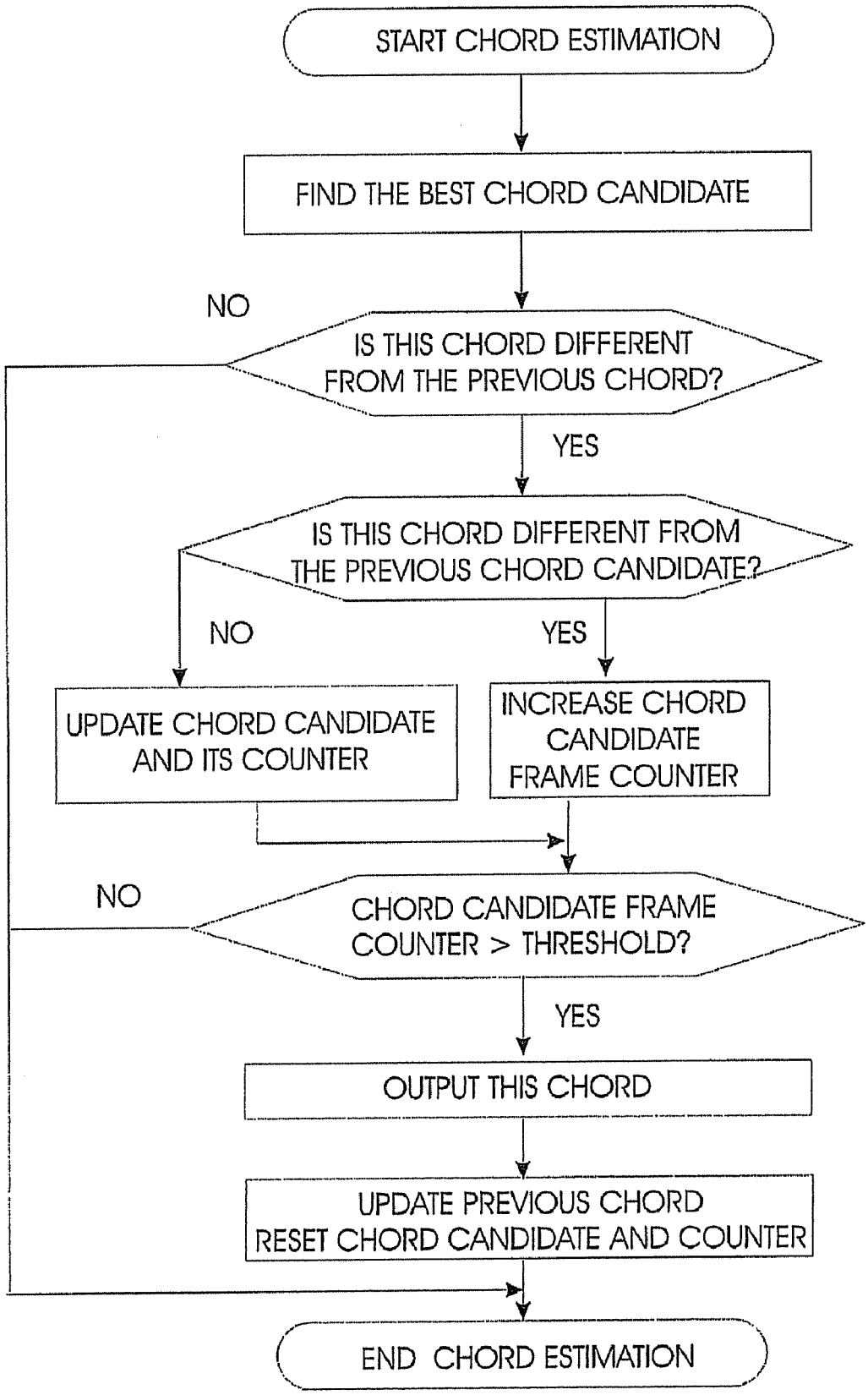
Figure 8:
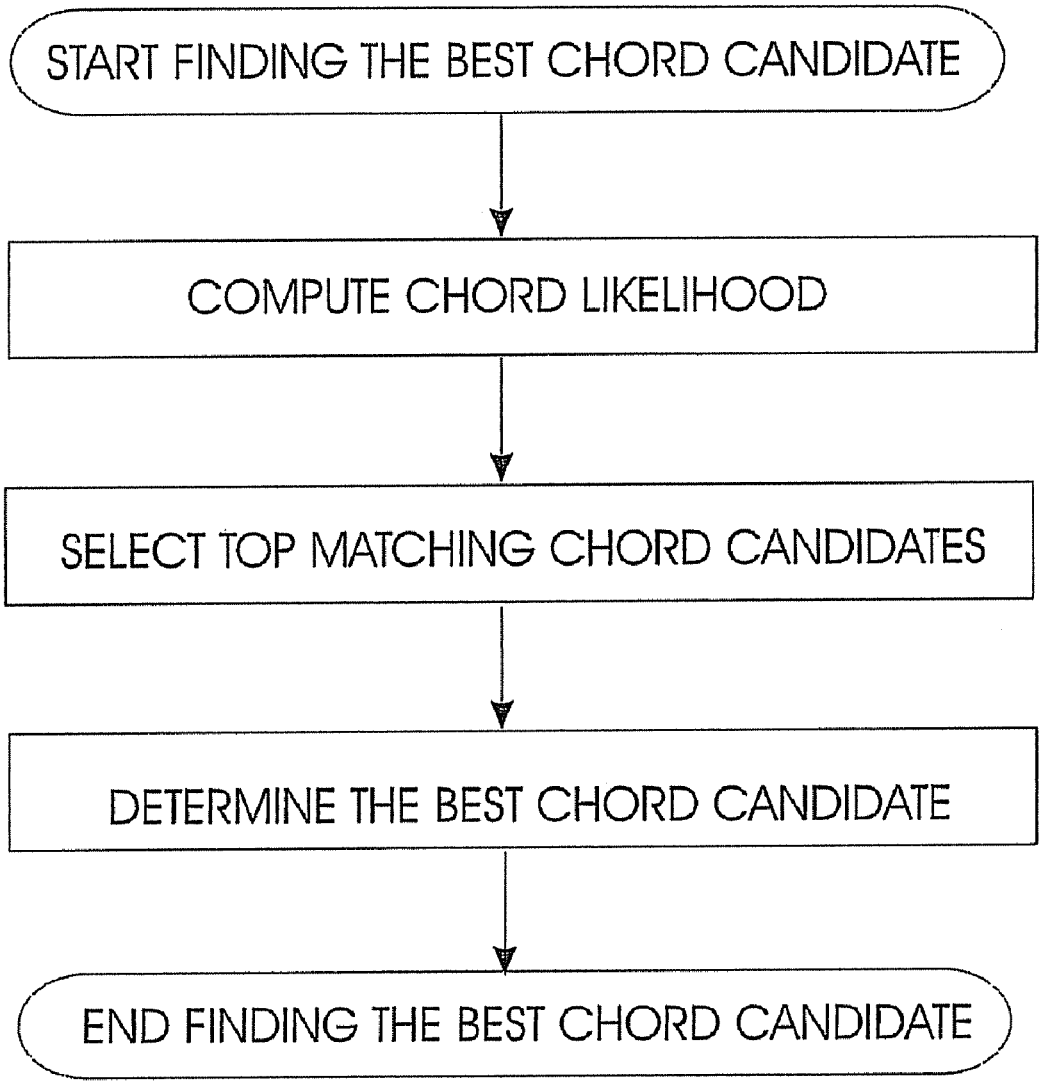
Figure 9:
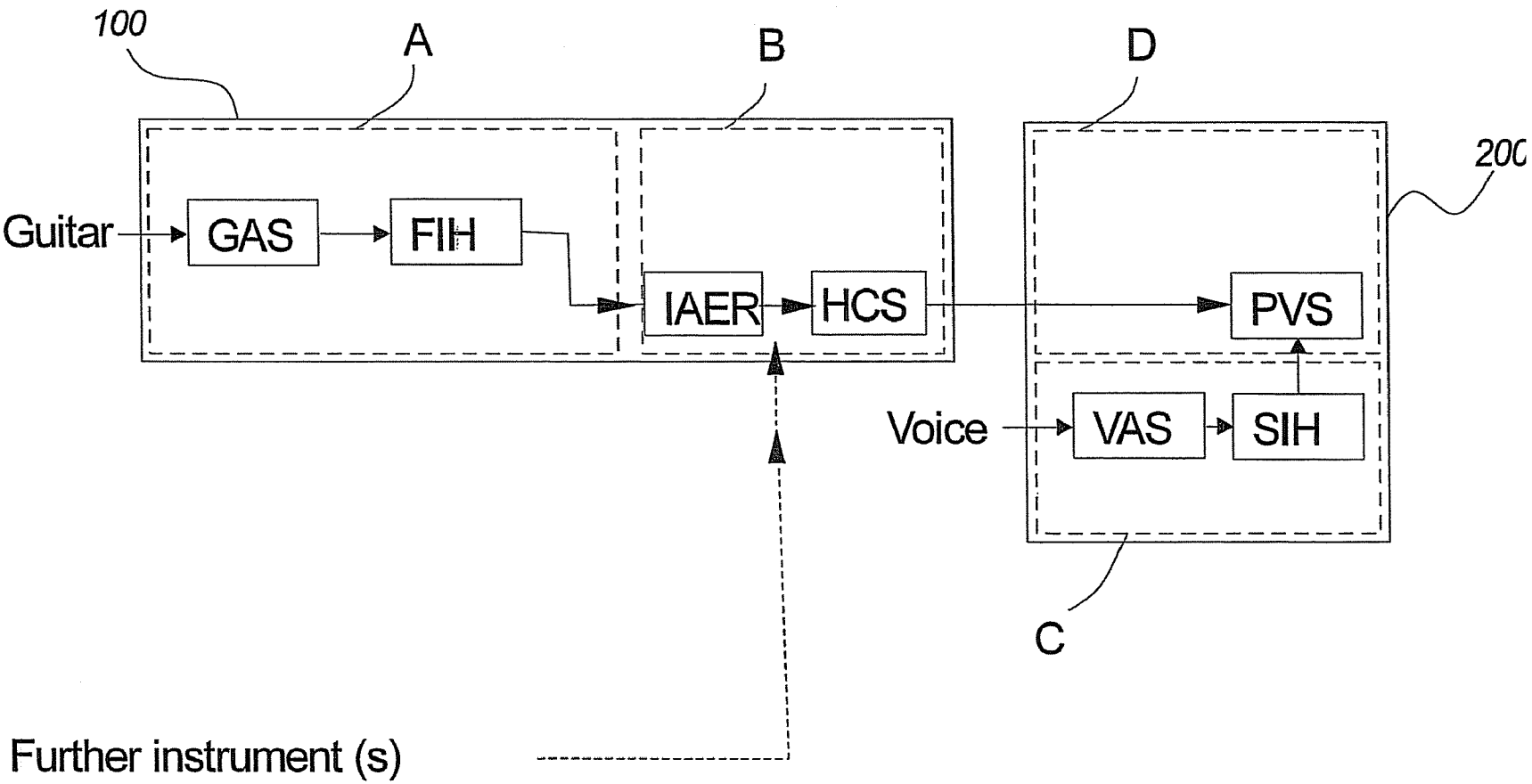

FIG. 1A illustrates a hardware structure of a harmony processor according to an embodiment of the invention, FIG. 1B illustrates principles of a method of establishing harmonies according to a preferred embodiment of the invention, FIGS. 2*a* and 2*b* illustrate a two different hardware structures within the scope of the invention, FIG. 3 illustrates flow chart of how to extract harmony information on the basis of chord estimation with the scope of the invention, FIG. 4 illustrates a method of establishing a representation of a guitar audio input signal according to a preferred embodiment of the invention FIGS. 5 and 6 illustrate two variants of how to provide an input audio extraction representation within the scope of the invention, FIG. 7 and FIG. 8 show how to perform harmony estimation and where FIG. 9 illustrates an advantageous embodiment of the invention.

DETAILED DESCRIPTION

General information to be referred to below:

Down-sampling (or sub-sampling) is the process of reducing the sampling rate of a signal. This is usually done to reduce the data rate or the size of the data.

The down-sampling factor (commonly denoted by M) is usually an integer or a rational fraction greater than unity. This factor multiplies the sampling time or, equivalently, divides the sampling rate.

MIDI (Musical Instrument Digital Interface) is an industry-standard electronic communications protocol which enables electronic musical instruments, computers and other equipment to communicate, control and synchronize with each other in real time. MIDI does not transmit an audio signal or media but simply transmits digital data "event messages" such as the pitch and intensity of musical notes to play, control signals for parameters such as volume, vibrato and panning, cues and clock signals to set the tempo. As an electronic protocol, it is known for its success, both in its ubiquitous widespread adoption throughout the industry, and in remaining essentially unchanged in the face of technological developments since its introduction in 1983.

According to Nyquist-Shannon's sampling theorem, perfect reconstruction of a signal is possible when the sampling frequency is greater than twice the bandwidth of the sampled signal, or equivalently, that the Nyquist frequency (half the sample rate) exceeds the bandwidth of the signal being sampled.

FIG. 1A shows the general hardware structure of a guitar extraction unit to be used in a harmony information extraction system according to one of several embodiments of the invention. The system comprises a digital signal processor 2, a microprocessor 8, an A/D converter 1, a UART 5, and input/output ports GUITAR INPUT, MIDI OUT. Both the digital signal processor 8 and the microprocessor can have ROMs 6,3 and RAMs 7,4 to store the required program and data. The digital signal processor runs the input audio extraction processing algorithm while the microprocessor handles the user interface. The A/D converter converts the analog guitar input into digital form while the UART transmits the MIDI information. The system can be expanded to comprise multiple A/D converters and UARTs to handle additional inputs and output signals.

The system may moreover interact with user controls 9 and display(s) 10.

A polyphonic voice signal may then be generated by a harmony processor (not shown) connected to the hardware structure via a MIDI connection. The voice harmony may e.g. be a TC Helicon VoiceWorks Harmony FX Voice Processor controlled by MIDI.

This harmony processor comprises a voice input and it may generate harmonies on the basis of the harmony processing algorithm of this unit and under real-time control by the output signal of the guitar extraction unit of FIG. 1A.

The structure of FIG. 1A may also e.g. be modified to include a harmony processor, thereby rendering the MIDI outbound connection superfluous.

FIG. 1B illustrates a method of establishing a harmony control signal controlled in real-time by a guitar audio input signal according to an embodiment of the invention.

The embodiment may e.g. be implemented in a system which the hardware structure of FIG. 1A forms part of.

The methods involves the steps of a establishing a harmony control signal controlled in real-time on the basis of a guitar audio input signal GAS fed to a corresponding hardware structure via a guitar input.

A first input harmony control signal FIH is then generated on the basis of said guitar audio input signal GAS and this signal is subsequently analyzed for the purpose of generating an input audio extraction representation IAER.

This input audio extraction representation may e.g. comprise note or chord information derived from the polyphonic guitar audio signal GAS. The first harmony input control signal FIH may e.g. comprise a straightforward A/D conversion of guitar audio signal GAS or any processed modification thereof.

It is noted that the input audio extraction representation IAER may be based on the first input harmony control signal FIH alone or e.g. advantageously in combination with said second input harmony control signal SIH.

Moreover, the method involves the steps of providing a second input harmony control signal SIH on the basis of a voice audio input signal VAS. The voice audio input signal VAS is obtained from a voice input.

When appropriate input extraction has been performed, and an input audio extraction representation IAER has been provided, a harmony control signal HCS may be established. This signal is understood to be a decision making for the purposes of establishing harmonies fitting to the input signals, e.g. the second and the first input signal. Such harmony decision may e.g. primitively include that a note "E" must be established as a harmony if the second input harmony signal, representing a voice, turns out to be a "C" and that the a has been extracted to be "C-major". Evidently such decision-making algorithms may be more or less complicated.

According to an advantageous embodiment of the invention analysis, extraction and harmony extraction may be performed by means of neural networks, i.e. artificial intelligence. One step or some or all steps in combination.

Finally, the method establishes a polyphonic voice signal PVS on the basis of said input audio extraction representation IAER and said second input harmony control signal SIH.

The second input harmony control signal SIH is applied as a signal upon which a harmony generation is based, e.g. by adding further pitch modulated voices. Moreover, the second input harmony control signal may optionally and advantageously be subject to input audio extraction as well thereby adding further information to the input audio extraction representation IAER.

Such information may e.g. comprise scale information as the voice input signal is typically monophonic.

Information obtained from the first input harmony input control signal FIH may typically relate to chord or harmony relevant extractions.

The input audio extraction representation IAER is then applied for establishment of a polyphonic voice signal PVS on the basis of said input audio extraction representation IAER and said second input harmony control signal SIH, i.e. a voice input signal.

The voice input signal is typically obtained by a microphone of any suitable kind.

Moreover, a control signal may be obtained from one or further instruments, polyphonic or monophonic. The further instruments may also include a further monophonic voice input.

One of the advantages of extracting information from a further input is that e.g. chord or scale information may be supplemented in an easy and effective way, thereby improving the quality or the generation speed of the input audio extraction representation IAER.

FIG. 2*a* shows an application of the harmony information extraction system. In this case, the harmony information extraction device functions as an independent unit. The MIDI outputs are sent to a harmony generation device to control harmony. The harmony generation device may e.g. be a TC Helicon VoiceWorks Harmony FX Voice Processor controlled by MIDI.

An alternative form of this application is shown in FIG. 2*b*. In this case, the harmony information extraction unit functions inside a harmony generation device.

General Flow of the Harmony Information Extraction Algorithm

FIG. 3 shows the block diagram of a harmony information extraction algorithm according to an embodiment of the invention. The guitar audio input is sampled with a suitable sampling rate such as 44.1 kHz. Depending on the sampling rate of the guitar input, the filtering and down-sampling module acts accordingly to down-sample the signal to a sampling rate that is no more than 12 kHz and no less than 1.3 kHz. Next, the time domain partitioning module partitions the down-sampled signal into a sequence of overlapping frames. The duration of each frame is no more than 1 second and no less than 100 milliseconds. The step size between two consecutive frames is no more than 100 milliseconds. It then checks the attributes of each frame to determine whether this frame is suitable for further analysis with one or a combination of multiple measures. Each valid frame is windowed and transformed into the frequency domain through FFT to obtain the frequency spectrum. The system then computes the pitch class profile using the peaks detected within a frequency span of a semitone. Finally, it determines the important harmony notes based on the pitch class profile, the music key and scale, and optionally with vocal input and historical data.

Filtering and Down-Sampling Processing

FIG. 4 shows the general flow diagram of the filtering and down-sampling module according to an embodiment of the invention. A low-cut filter is applied to the input to reduce low-frequency noise. Then the signal goes through an anti-aliasing filter followed by the down-sampling operation. The purpose of the anti-aliasing filter is to remove high frequency components that could cause aliasing during the down-sampling operation.

The lowest note on a regularly tuned guitar is E2, which is 82.4 Hz (assuming the tuning reference is 440 Hz). Sometimes, a player may intentionally tune the lowest note to D2, which is 73.4 Hz. In the harmony note extraction device, a low-cut filter with cut-off frequency of no more than 85 Hz can be used to reduce low frequency noise.

The highest note played on a guitar varies with the number of frets available (or playable). On a 21-fret guitar, the highest note you can play is C#6, which is 1108.7 Hz. The highest note in a playable chord is typically lower than this value. As a result, down-sampling is desirable for efficient DSP operations. Alternatively, the system can also sample the input audio signal directly at a lower sampling rate. The absolute minimum sampling rate should be no less than 1.3 kHz to be able to process commonly used guitar chords. With the power of DSP hardware continues to increase, it is possible to process the signal at higher sampling rates such as 11 kHz (or 12 kHz for a 48 kHz input).

Note:

1) In practical applications, one may choose to apply anti-aliasing filtering and down-sampling multiple times so that the signal is down-sampled by a small factor each time.
2) One may also choose to place low-cut filtering after down-sampling to achieve equivalent results.

It is noted in relation to FIG. 4 that the purpose of the setup is to convert a guitar audio input signal GAS into a sample rate appropriate and applicable with the invention. An alternative to this process of converting a relatively high speed and subsequently down-sampling the signal may e.g. be an initial A/D conversion directly into the desired low sample rate.

In this context, it should be noted that the applied A/D converted must be a high-resolution converter such as a delta-sigma or a PWM A/D converter.

Frame Attribute Check

The harmony note extraction contains a frame attribute check module which checks the properties of each frame to determine whether this frame is suitable for harmony information extraction processing. The guitar audio input can contain many segments that do not contain any useful harmony information. It is crucial to skip these segments. The system can utilize one or a combination of multiple techniques to check the attributes of each frame. These techniques include but are not limited to voiced/unvoiced check, energy check, etc.

Pitch Class Profile Estimation

FIG. 5 shows the general flow diagram of one example of a pitch class profile estimation module according to an embodiment of the invention. The module first estimates the strength of each semitone based on the frequency spectrum, which can be obtained through either FFT or constant Q transform. If FFT is used, the system estimates the strength of each semitone by finding the peaks within the frequency span of each semitone. The system can utilize the maximum peak found for each semitone, and use it to represent the strength of that semitone. The system then adds semitone strengths that belong to the same pitch class to obtain the pitch class profile. Alternatively, the system may use all the peaks presented in the frequency span of a semitone and averaging them before summing.

The pitch class profile estimation module can optionally apply either a fixed or a variable threshold (or a combination of both) to the semitone strength so that only the semitone strength that exceeds the threshold is used for pitch class profile estimation.

FIG. 6 shows an alternative approach for pitch class profile estimation. In this approach, the system estimates the strength of each semitone as discussed above. After that, the system first selects the unique pitch class candidates. Then it refines the unique pitch class among the pitch class candidates. Finally, the system calculates the strength of each unique pitch class by adding the strength of its harmonics or sub-harmonics.

Chord Estimation Processing

FIG. 7 shows a flow diagram of a chord estimation module according to one embodiment of the invention. The system first selects the best match chord candidate by comparing the pitch class profile with the default chord patterns. Then it checks to see if the chord candidate is the same as the previous chord displayed. If the chord candidate is the same as the previous chord, the system skips the remaining steps and returns. Otherwise, the system checks if the current chord candidate is different from the previous chord candidate. If the current chord candidate is different from the previous chord candidate, the system updates both the previous chord candidate and its counter. Otherwise, it simply increases the counter of the previous chord candidate. Then it checks to see if the previous chord candidate counter exceeds the pre-determined threshold. If yes, the system outputs this chord and update previous chord. It also reset previous chord candidate and its counter. If no, the system returns.

Chord Priority Considerations

If the system knows the key of the music, then the system give different chords different level of priorities. For instance, when the music key is C major, the chord priorities can be assigned as shown in table 1.

TABLE 1

An example chord priority table when the key is C major.

| | |
|---|---|
| High Priority | C, Dm, Em, F, G, Am, Gsus, C_M7, F_M7, D_m7, A_m7, G_m7, C_m7, F_m7 |
| Medium Priority | Fm, Bb, D, Csus, Gm, Fsus, F_m7, D_m7 |
| Low Priority | Bdim, B_dim7 |
| None | All other chords |

The chord priorities can be used in conjunction with chord likelihood to select the best chord candidates. One can also optionally consider chord history. For instance, one can assign a higher priority to the chords that have been detected among the previous 10 chords.

FIG. 8 shows the general steps involved in finding the best chord candidates. The system first computes the likelihood of each chord type by matching the pitch class profile with the default chord patterns. For example, [1,0,0,0,1,0,0,1,0,0,0,0] can be used to represent C major. The matching process can be carried out by taking the inner product of the pitch class profile and the default chord patterns. The pitch class profile vector is shifted one element at a time to find the correct root of each chord. Alternatively, one can also use a weighted default chord vector by utilizing either neural networks or machine learning techniques. Next, the system determines the top matching chord candidates by sorting the likelihood values. It then determines the best matching chord candidate either by select the chord with the highest likelihood value or considers chord likelihood values in combination with chord priorities and chord history.

Harmony Note Extraction

An idea in an embodiment of harmony note extraction module within the scope of this invention is to utilize music key and scale information, pitch class profile information, and optionally with historical data and vocal input to extract important harmony notes. The music key and scale information can be obtained through user manual input, historical data, or guitar input. The algorithm can optionally detect/adapt to a player's style for better decision making.

FIG. 9 illustrates a method of establishing a harmony control signal controlled in real-time by a guitar audio input signal according to an embodiment of the invention.

The embodiment may e.g. be implemented in a system which the hardware structure of FIG. 1A forms part of.

The method basically corresponds to the method described above with reference to FIG. 1B, but now the method has been implemented in two separate hardware units 100 and 200.

The first hardware unit 100 is dedicated for the receipt of a first input harmony control signal FIH and the second hardware unit 200 is dedicated for the receipt of a second input harmony control signal SIH.

The first input harmony control signal FIH may typically comprise a polyphonic guitar input signal received through a dedicated input.

The second input harmony control signal SIH may typically comprise a voice signal received through a dedicated input.

The second hardware unit 200 may e.g. comprise a TC Helicon VoiceWorks Harmony FX Voice Processor controlled by MIDI received from the first hardware unit 100.

The methods involves the steps of a establishing a harmony control signal controlled in real-time on the basis of a guitar audio input signal GAS fed to a corresponding hardware structure via a guitar input.

A first input harmony control signal FIH is then generated on the basis of said guitar audio input signal GAS and this signal is subsequently analyzed for the purpose of generating an input audio extraction representation IAER.

This input audio extraction representation may e.g. comprise note or chord information derived from the polyphonic guitar audio signal GAS. The first harmony input control signal FIH may e.g. comprise a straightforward A/D conversion of guitar audio signal GAS or any processed modification thereof.

It is noted that the input audio extraction representation IAER may be based on the first input harmony control signal FIH alone or e.g. advantageously in combination with said second input harmony control signal SIH.

Moreover, the method involves the steps of providing a second input harmony control signal SIH on the basis of a voice audio input signal VAS. The voice audio input signal VAS is obtained from a voice input.

When appropriate input extraction has been performed, and an input audio extraction representation IAER has been provided, a harmony control signal HCS may be established. This signal is understood to be a decision making for the purposes of establishing harmonies fitting to the input signals, e.g. the second and the first input signal. Such harmony decision may e.g. primitively include that a note "E" must be established as a harmony if the second input harmony signal, representing a voice, turns out to be a "C" and that the a has been extracted to be "C-major". Evidently such decision-making algorithms may be more or less complicated.

According to an advantageous embodiment of the invention analysis, extraction and harmony extraction may be performed by means of neural networks, i.e. artificial intelligence. One step or some or all steps in combination.

Finally, the method establishes a polyphonic voice signal PVS on the basis of said input audio extraction representation IAER and said second input harmony control signal SIH.

The second input harmony control signal SIH is applied as a signal upon which a harmony generation is based, e.g. by adding further pitch modulated voices. Moreover, the second input harmony control signal may optionally and advantageously be subject to input audio extraction as well thereby adding further information to the input audio extraction representation IAER.

Such information may e.g. comprise scale information as the voice input signal is typically monophonic.

Information obtained from the first input harmony input control signal FIH may typically relate to chord or harmony relevant extractions.

The input audio extraction representation IAER is then applied for establishment of a polyphonic voice signal PVS on the basis of said input audio extraction representation IAER and said second input harmony control signal SIH, i.e. a voice input signal.

The voice input signal is typically obtained by a microphone of any suitable kind.

Moreover, a control signal may be obtained from one or further instruments, polyphonic or monophonic. The further instruments may also include a further monophonic voice input.

One of the advantages of extracting information from a further input is that e.g. chord or scale information may be supplemented in an easy and effective way, thereby improving the quality or the generation speed of the input audio extraction representation IAER.

The invention claimed is:

1. A method of generating a harmony in real-time based on a guitar audio input, comprising:

inputting a guitar audio input signal;

inputting a voice audio input signal;

calculating an input audio extraction representation including a peak analysis of a frequency spectrum derived from said guitar audio input signal;

calculating a decision making harmony control signal, on the basis of said input audio extraction representation, that determines a harmony relative to the voice audio input signal; and outputting a tone based on the harmony.

2. The method according to claim 1, wherein a polyphonic harmony signal is generated on the basis of the decision making harmony control signal and output on a harmony output.

3. The method according to claim 1, wherein said guitar audio input signal is sampled or downsampled to a sample rate that is less than about 13 kHz.

4. The method according to claim 1, wherein said guitar audio input signal is digitally represented at a rate of less than about 13 kHz and greater than about 1.3 kHz.

5. The method according to claim 1, wherein said input audio extraction representation is calculated through detection of fundamental tones less than 6.5 kHz of the guitar audio input signal.

6. The method according to claim 1, wherein said input audio extraction representation is calculated through detection of fundamental tones less than 3.0 kHz of a guitar audio input signal.

7. The method according to claim 1, wherein said guitar audio input signal is provided on the basis of an A/D conversion of a guitar audio input.

8. The method according to claim 1, wherein said guitar audio input signal is provided on the basis of an A/D conversion of a guitar audio input and a subsequent down-sampling of said guitar audio input.

9. The method according to claim 1, wherein said input audio extraction representation is calculated by analysis of said guitar audio input signal and said voice audio input signal.

10. The method according to claim 1, wherein said input audio extraction representation is calculated by analysis of said guitar audio input signal, said voice audio input signal, and an additional input signal.

11. The method according to claim 1, wherein said guitar audio input signal is analyzed in time windows of less than about 1500 ms.

12. The method according to claim 1, wherein said guitar audio input signal is analyzed in time windows of more than about 80 ms.

13. The method according to claim 1, wherein said guitar audio input signal is analyzed in time windows of 100 ms to 1000 ms.

14. The method according to claim 1, wherein said guitar audio input signal is analyzed in overlapping time windows.

15. The method according to claim 14, wherein a step size between a beginning of two consecutive time windows is less than 100 ms.

16. The method according to claim 1, wherein the input audio extraction representation is calculated by note detection of the guitar audio input signal.

17. The method according to claim 1, wherein the input audio extraction representation is calculated by note and chord detection of the guitar audio input signal.

18. The method according to claim 1, wherein the input audio extraction representation is calculated by note, chord, and scale detection of the guitar audio input signal.

19. The method according to claim 1, wherein at least one of a decision making harmony control signal and a polyphonic harmony signal is calculated on the basis of said input audio extraction representation and said voice audio input signal and wherein said polyphonic harmony signal is output time-synchronized with said voice audio input signal.

20. The method according to claim 1, wherein at least one of a decision making harmony control signal and a polyphonic harmony signal is calculated on the basis of said input audio extraction representation and said voice audio input signal and wherein said polyphonic harmony signal is output time-synchronized with said guitar audio input signal.

21. The method according to claim 1, wherein a polyphonic harmony signal is established as a harmony of two or more different voices, one of the voices being based on the voice audio input signal, one of the other voices being based on a pitch shifted version of said voice audio input signal, and said two or more voices being time-synchronized with said voice audio input signal.

22. The method according to claim 1, wherein the input audio extraction representation calculates chord information on the basis of said guitar audio input signal and scale information on the basis of said voice audio input signal.

23. A hardware structure comprising a signal processor for implementing the method of claim 1.

24. A hardware structure according to claim 23, wherein the hardware structure is implemented on a computer.

25. The method according to claim 1, wherein the guitar audio input signal is provided by a high resolution A/D conversion of a guitar audio.

26. A method for use with a received analog guitar input signal, the method comprising:

sampling and partitioning a guitar input signal into a sequence of overlapping time frames;

transforming time frames determined to contain suitable harmony information into a frequency spectrum;

obtaining an analysis of peaks in the frequency spectrum;

transforming the frequency spectrum analysis into a decision making harmony control signal that determines at least one tone specific to a corresponding voice audio input signal; and outputting the tone.

* * * * *

UNITED STATES PATENT AND TRADEMARK OFFICE
Certificate

Patent No. 7,667,126 B2

Patented: February 23, 2010

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Guangji Shi, Victoria (CA); and David Hilderman, Victoria (CA).

Signed and Sealed this Thirteenth Day of November 2012.

ELVIN ENAD
*Supervisory Patent Examiner*
Art Unit 2832
Technology Center 2800